US007439699B1

(12) United States Patent
Earnest

(10) Patent No.: US 7,439,699 B1
(45) Date of Patent: Oct. 21, 2008

(54) ANIMATRONICS SYSTEMS AND METHODS

(75) Inventor: Michael Lawrence Earnest, Yucca Valley, CA (US)

(73) Assignee: Dreamation, Inc., Yucca Valley, CA (US)

( * ) Notice: Subject to any disclaimer, the term of this patent is extended or adjusted under 35 U.S.C. 154(b) by 70 days.

(21) Appl. No.: 11/412,422

(22) Filed: Apr. 26, 2006

Related U.S. Application Data

(60) Provisional application No. 60/675,070, filed on Apr. 26, 2005.

(51) Int. Cl.
*B25J 9/18* (2006.01)

(52) U.S. Cl. ..... 318/568.11; 318/568.12; 318/568.13

(58) Field of Classification Search ..... 318/568.11, 318/568.12, 568.13, 569, 567; 901/1; 711/168; 446/298

See application file for complete search history.

(56) References Cited

U.S. PATENT DOCUMENTS

| | | | | |
|---|---|---|---|---|
| 5,074,821 | A | 12/1991 | McKeefery et al. | |
| 5,108,341 | A | 4/1992 | DeSmet | |
| 6,012,961 | A | 1/2000 | Sharpe, III et al. | |
| 6,313,386 | B1 | 11/2001 | Capobianco et al. | |
| 6,882,824 | B2 | 4/2005 | Wood | |
| 2006/0069896 | A1 * | 3/2006 | Sanders | 711/168 |

* cited by examiner

*Primary Examiner*—Karen Masih
(74) *Attorney, Agent, or Firm*—Knobbe, Martens, Olson & Bear LLP

(57) ABSTRACT

An animatronics system and method for incorporation in talking toys, puppets, animated special effects and costumes. The system utilizes a removable storage device such as a flash memory chip to store pre-programmed audio and animation data and a microcontroller configured with both an audio player and an animation player. The microcontroller is adapted to access the audio and animation data and play the data in a manner such that the system produces synchronized sound and movement. The system also incorporates an auto-tuning system which automatically calibrates the system to compensate for variations in the arrangement of mechanical components in individual units.

14 Claims, 6 Drawing Sheets

ANIMATRONICS SYSTEMS AND METHODS

CROSS-REFERENCE TO RELATED APPLICATIONS

This application claims the benefit of priority under 35 U.S.C. §119(e) of U.S. Provisional Application No. 60/675,070 filed on Apr. 26, 2005 and entitled MECHANICAL TOY ANIMATION AND AUDIO PROGRAMMING AND PLAYBACK CONTROL SYSTEM, the entirety of which is incorporated herein by reference.

BACKGROUND OF THE INVENTION

1. Field of the Invention

This invention generally relates to animatronics, and in particular, relates to systems and methods for providing synchronized sound and movement in animatronics systems.

2. Description of the Related Art

Electro-mechanical toys capable of producing synchronized sound and movement are known in the art. Most of these toys operate based on pre-programmed audio and animation control data in conjunction with a servo motor and mechanical drive system. The audio and animation program data are typically recorded on different tracks of a dual track cassette tape. A tape playback unit is usually installed in the toy and can read the audio and animation control signals on the tape to enable synchronized sound and movement of the toy. In many cases, the audio data is processed to generate sound in the form of a song or story through a speaker on the toy. The animation control data is processed to cause the servo motor and drive system to move different parts of the toy, such as mouth or eyes, in sync with the story or music. However, one drawback associated with using pre-recorded cassette tapes and tape playback devices for storing and reading sound and animation data is that these components add weight and bulk to the toy. Additionally, magnetic tape media tends to deteriorate in quality after repeated use and thus can decrease the reliability of the data stored therein.

In recent years, digital storage devices such as flash memory chips have replaced cassette tapes in storing audio and animation program data for some toys. However, both the sound and animation data in these toys are typically transmitted in the form of audio output signals, which are subsequently routed by a switching network to either the servo motor or the audio output. The requirement of a switching network to route the audio output signals in these digital based toys creates certain inconvenience and adds to the complexity of the system. Thus, there is a need for an improved system and method of using digital technology to synchronize sound and movement in animatronics toys.

SUMMARY OF THE INVENTION

The preferred embodiments of the animatronics system and method have several features, no single one of which is solely responsible for their desirable attributes. Without limiting the scope of this invention, its more prominent features will now be discussed briefly. However, not all of the following features are necessary to achieve the advantages of the system. Therefore, none of the following features should be viewed as limiting. After considering this discussion, and particularly after reading the section entitled "Detailed Description of the Preferred Embodiments," one will understand how the features of the preferred embodiments provide advantages over prior art systems.

In one aspect, the preferred embodiments of the present invention provide an animatronics system. The system comprises a memory storage device containing digital audio and animation data, a movable part, an audio output device, an electro-mechanical actuator adapted to move the movable part in response to the animation data, and a microcontroller electrically coupled to the memory storage device. In one embodiment, the microcontroller comprises an audio player and an animation player. The audio player is electrically coupled to the audio output device and adapted to process the audio data to result in production of sound through the audio output device. The animation player is electrically coupled to the electro-mechanical actuator and adapted to direct electrical signals to the electro-mechanical actuator in response to the animation data so as to cause movement of the movable part. Preferably, the movement is synchronized with the sound produced through the audio output device. In one embodiment, the electro-mechanical actuator comprises a servo chip and a servo motor.

In another aspect, the preferred embodiments of the present invention provide a method of providing synchronized sound and movement in a toy. The method comprises programming audio and animation data in a digital data storage device; providing a microcontroller having audio firmware adapted to read and process the audio data and animation firmware adapted to read and process the animation data; providing a user interface; and electrically coupling the microcontroller with the user interface and the digital data storage device.

In another aspect, the preferred embodiments of the present invention provide an animatronics toy. The toy comprises a flash memory chip wherein the chip contains stored audio and animation files. The toy also comprises a microcontroller wherein the microcontroller has an audio firmware adapted to play the audio files and an animation firmware adapted to play the animation files. The toy also includes an audio interface for generating sound in response to the data in the audio files and an animation interface for enabling movement of the various mechanical components of the toy. In one embodiment, the animation interface comprises a servo chip, a servo motor, an H-Bridge unit, and a feedback pot.

DETAILED DESCRIPTION OF THE PREFERRED EMBODIMENT

Figure 1:
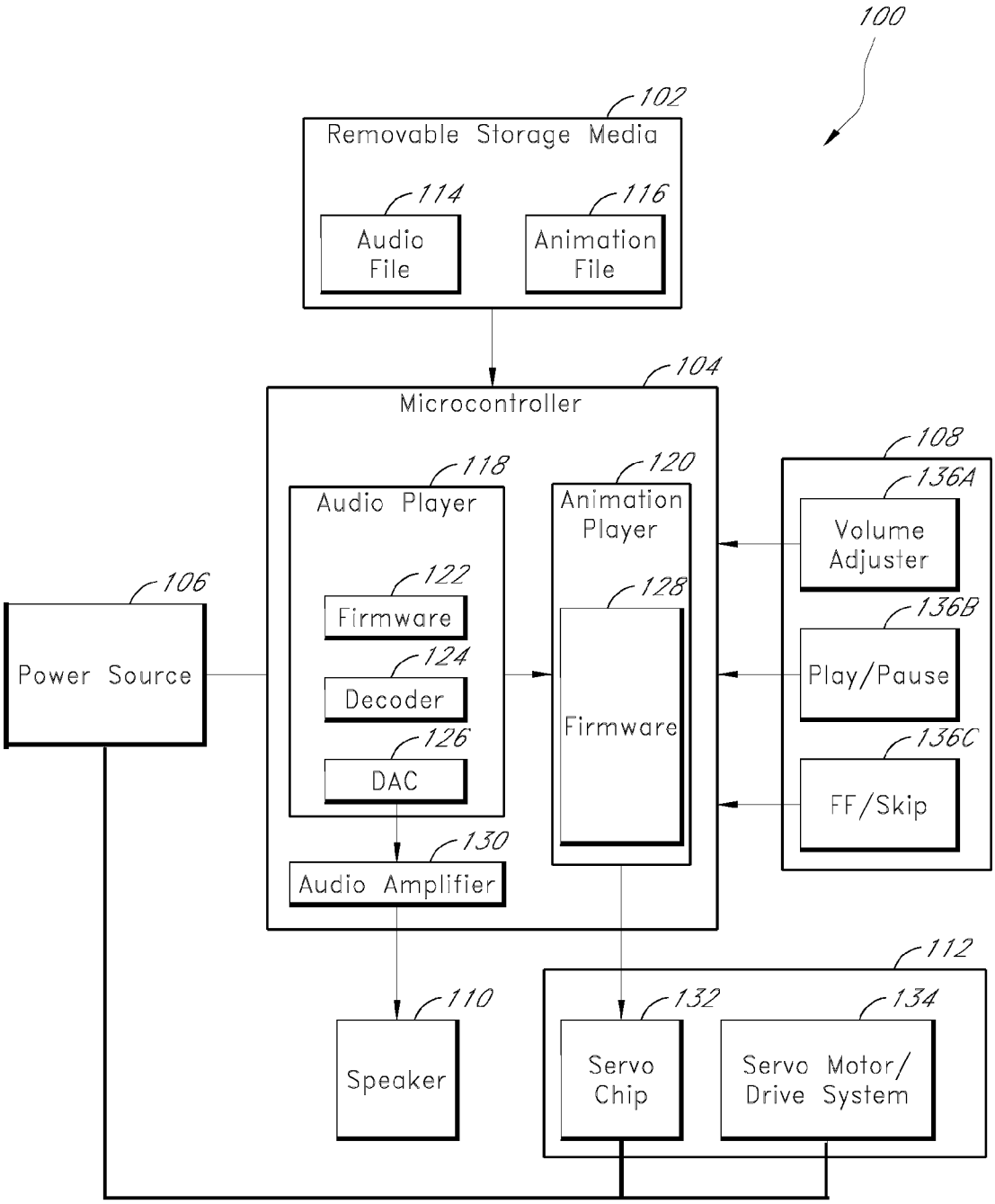
FIG. 1 is a general schematic illustration of an animatronics system of one embodiment of the present invention.

FIG. 1 is a general schematic illustration of an animatronics system 100 in accordance with one embodiment of the present invention. As described in greater detail below, the system 100 can be embodied in the form of talking toys, puppets, animated special effects, animated costumes and the like. The system 100 comprises a storage media 102 for storing audio and animation program data, a microcontroller 104 for retrieving and processing the data to produce synchronized sound and animation, a power source 106 for supplying power to the system, a user interface 108 for users to control one or more operational parameters of the system, a speaker 110 for sound output, and an animation interface 112 for enabling movement of one or more mechanical components of the system.

In one implementation, the storage media 102 is a solid state memory device such as flash ROM, EEPROM, EPROM, ROM, USB Smart Drive. Preferably, the storage media 102 is removably attached to the system 100 so that it can be readily replaced and interchanged with storage media programmed with different content. The storage media 102 preferably contains both audio files 114 and animation files 116. In one embodiment, the audio files 114 are in a compression format such as M-PEG1 Audio Layer, including MP2, MP3, or MP4 format. The animation files 116 contain data related to controlling servo, motor, cylinder, solenoid, or other electromechanical devices. The audio and animation files 114, 116 are programmed and stored in the storage media 102 using methods and formats known in the art. In one embodiment, the storage media 102 is a flash memory chip having track(s) adapted for storing audio files and separate track(s) or sector(s) adapted for storing animation file. In embodiments where the audio data is in M-PEG1 format and comprises a number of different songs or stories to be played in order, the audio data is preferably stored in separate files, arranged in the play order. However, the animation data that correspond to each of these audio files can be condensed into a single animation file on the flash memory chip. In some implementations, the number of tracks or sectors allocated for audio and animation files on each flash memory chip can vary and is adjustable depending on the space required for each file type.

The microcontroller 104 is configured to retrieve and process audio and animation data from the storage media 102 when the system 100 is activated. In one embodiment, the microcontroller 104 comprises an audio player 118 and an animation player 120. The audio player 118 comprises firmware 122 adapted to control the play of audio files stored in flash memory. The audio player 118 further comprises a hardware decoder 124, such as an MP3 decoder for decoding MP3 audio files 114, and a digital to analog converter 126 for converting digital audio signals to analog so as to generate sound through the speaker 110. Preferably, the audio player firmware 122 comprises software programmed and stored in the microcontroller using methods known in the art. In one embodiment, the audio player firmware 122 includes the functionalities of monitoring user activation of the play, pause, fast forward, and other switches to determine when and which audio track(s) to play, instructing the audio player to play the selected audio track(s), sending command to the animation player to begin playing animation that corresponds to the selected audio track(s), and keeping the animation player in sync with the audio player. In one embodiment, the audio player 118 is an MP3 player. The animation player 120 comprises firmware 128 which includes the functionalities of receiving a command from the audio player to play a certain animation track, locating the animation track in the flash memory, playing the selected animation track, adjusting the playing parameters to keep in sync with the audio files being played by the audio player, sending signals to the animation interface 112 to enable animation of the system.

In some embodiments, the microcontroller 104 further includes a built-in audio amplifier 130 which drives the speaker 110 directly. In other embodiments, the audio amplifier 130 can be placed on the speaker 110 or other locations in the system 100. As further shown in FIG. 1, the animation interface 112 comprises a servo chip 132 and a servo motor/drive system 134. The servo motor/drive system 134 can be those known in the art or described in U.S. Pat. No. 5,074,821, which is hereby incorporated by reference in its entirety. In one embodiment, the servo chip 132 comprises a pulse width modulation processor. The functionalities of the animation interface 112 will be described in greater detail below.

In a general sense, when the system 100 is activated by the user via the user interface 108, the audio player 118 in the microcontroller 104 identifies and plays the appropriate audio track in the flash memory 102. The audio player 118 converts the digital audio signals into analog signals, which in turn causes pre-programmed sound to be generated by the speaker 110. The audio player 118 also instructs the animation player 120 in the microcontroller 104 to begin playing the corresponding animation track in the flash memory. The animation player 120 in turn sends signals to the animation interface 112 which triggers the servo motor to drive the movement of one or more mechanical gears and linkages in accordance with pre-programmed animation routines. The audio player and animation player are both located in the same microcontroller chip and their firmware are also programmed in the same chip so as to reduce the number of components and simplify the system.

Figure 2:
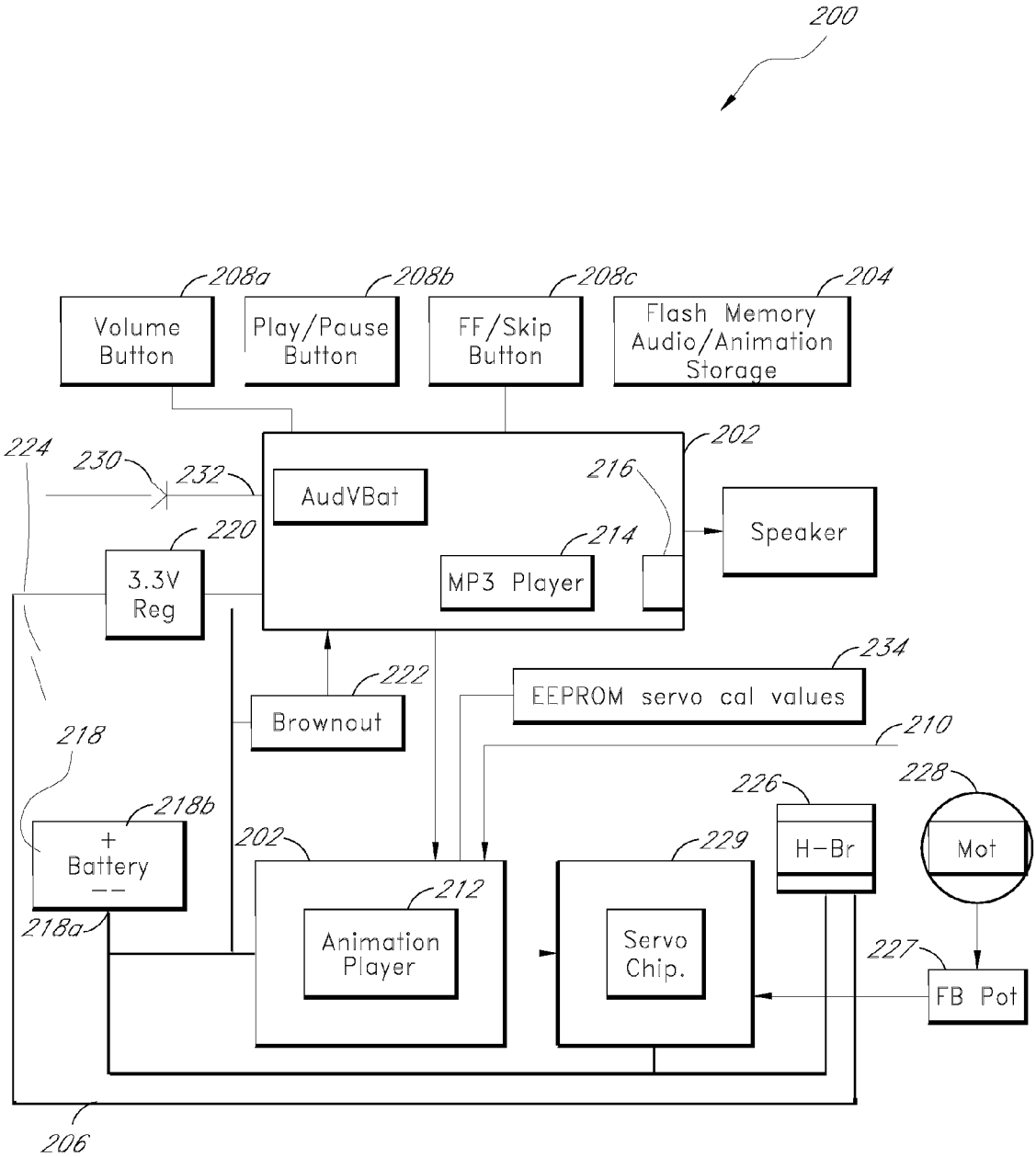
FIG. 2 is a general schematic illustration of an animatronics system of another embodiment of the present invention.

FIG. 2 is a general schematic illustration of an animatronics system 200 in accordance with another embodiment of the present invention. The system 200 can be incorporated as part of a talking toy, such as a talking teddy bear capable of moving its eyes and jaws in sync with pre-programmed story or music. The system 200 comprises a microcontroller 202, a flash memory storage device 204, a power circuit 206, a user interface 208*a-c*, and a servo mechanism 210. In a preferred implementation, the microcontroller 202 is an ATMEL AT89C51SND2C chip configured to include an animation player 212, an MP3 player 214, and a built-in audio amplifier 216. The flash memory device 204, in one embodiment, is a flash memory chip capable of storing both audio and animation data. The user interface 208*a-c* may include a volume button 208*b*, a play/pause button 208*b*, and a fast forward/skip button 208*c*. Certain key components and features of the system 200 will be described in greater detail below.

Power Circuit

As shown in FIG. 2, the power circuit 206 of the system 200 includes a battery 218 which is capable of supplying between about 6.5 V to 4.5 V DC, depending on the age of the battery and the current draw. The power circuit 206 also includes a 3.3 V regulator 220 because the chip 202 generally requires a regulated voltage of 3.3 V and an unregulated higher voltage of about 6.0 V down to 3.3 V. The unregulated voltage is used to power the audio amplifier 216 which typically requires a higher voltage. The battery negative 218*a* can be connected directly to the ground pins on the chip 202, the 3.3 V regulator 220, a brown-out detector chip 222, and various other places requiring ground potential. The battery positive 218*b* can be connected through a disconnect switch 224 to the input to the 3.3 V regulator 220, the top of an H-Bridge 226 to drive a motor 228 that is part of the servo mechanism 210, and through a diode 230 to an AudVBat line 232 on the chip 202. In a preferred embodiment, the 3.3 V regulator 220 supplies 3.3 V to the chip 202 when the switch 224 is closed as long as the battery voltage is above about 4.2 V. In some embodiments, the power circuit 206 includes a diode 230 in an AudVBat line 232, which provides the necessary 0.5 V drop so that a fresh battery will not exceed the maximum voltage on the AudVBat line 232. The H-Bridge 226 preferably receives the full battery voltage so that maximum possible voltage is available to drive the servo motor 228. In some embodiments, a lower voltage could result in the motor running slower, which in turn results in poor quality animation.

The power circuit 206 also includes a brownout detector chip 222, which is configured to compare the output of the 3.3 V regulator 220 to a threshold voltage, preferably about 2.7 V in some embodiments. Operating the chip below a threshold voltage could cause damage to the firmware, calibration values in the chip, and even content in the flash memory. Thus, when the 3.3 V line drops below a threshold voltage, the chip 202 will reset and stop all playback so as to reduce battery draw to a minimum.

MP3 Player

The MP3 player 214 is part of the ATMEL AT89C51SND2C chip 202. The MP3 player 214 comprises a hardware MP3 decoder, firmware, a DAC, and a mixer and audio amplifier. The play/pause and fast forward buttons 208*b*, 208*c* on the user interface are monitored by the firmware of the MP3 player. If the firmware detects that the play/pause button is pressed and the MP3 player 214 is not playing, a request will be made to open the next audio file on the flash memory device and play the selected file. If the play/pause button is pressed while the MP3 player is playing, the firmware will instruct the MP3 player to pause. If the play/pause button is pressed again, the firmware will instruct the system to exit pause mode and resume playing. If the ff/skip button 208*c* is pressed momentarily, the MP3 player will be instructed to stop playing the current track, advance to the next track, and begin playing. If the last track on the memory device is playing when the ff/skip button is pressed, the MP3 player will be instructed to advance back to the first track. If the ff/skip button 208*c* is held down for about a second, the MP3 player will begin a scan mode in which it advances several seconds into the track, plays about half a second of audio, and then advances to the next track and plays again. This will continue as long as the ff/skip button is held down. The firmware also monitors the volume button 208*a*. Each time the volume button is pressed, the volume will be advanced to the next level. In one embodiment, there are three volume levels, and after the setting has reached the third level, it will revert back to the first level. In a preferred embodiment, the system powers up with the lowest volume setting and the same volume setting is used for playing all tracks. The current volume setting is maintained until the system is powered off.

Animation Player

The animation player 212 is also part of the chip 202 and comprises firmware adapted to play the animation data stored in flash memory 204. In one embodiment, the animation data can be played back at about 25 frames per second. In another embodiment, the animation player 212 is capable of playing a track from a flash memory device without sound. When the MP3 player 214 begins playing a track from the flash memory device, the MP3 player firmware sends a command to the animation player to begin playing the animation for the selected audio track number. The animation player 212 locates the animation data and begins playing the track. To keep the animation in sync with the audio, the MP3 player sends a position to the animation player about once a second. If the animation player determines that its position is more than two frames off from the audio position, it will adjust to the current audio position in the animation player. When the MP3 player is fast forwarded, the animation is muted. The synchronization logic then causes the animation player to jump to the new audio position and again playing in sync with the audio. In one embodiment, the animation player makes a stream of bytes at about 25 bytes per second per animation channel. The bytes have values of 0 to 255, which correspond to a position of one mechanical component such as the position of the eyes of the toy completely closed, which corresponds to 0, to mouth completely open, which corresponds to 255. In some embodiments, the mechanical arrangement is not completely centered, there may be more movement for the jaw than for the eyes. In a preferred implementation, the center value is at around 100.

Servo Mechanism

In one embodiment, the bytes from the animation player 212 are sent to a software routine that converts the value to a pulse length. For example, a value of 0 can be converted to a pulse of about 1 ms long and a value of 225 can be converted to a pulse of about 2.5 ms long. These values are not exact and can vary from one mechanical unit to another. These pulses normally occur every 10 ms, but can occur less frequently. A servo chip 229 takes a varying pulse width and an analog feedback voltage from a pot 227, and uses these values to determine which way, if any, it needs to drive the H-Bridge unit 226. The H-Bridge unit, in turns, supplies power to a servo motor 228. As the servo motor turns, it actuates movement of the feedback pot 227 and other mechanical components of the system, such as opening and closing the eyes and jaw of the toy. The servo chip 229 is capable of internally determining when the motor is in the correct position. At that point, the servo chip 229 will stop driving the H-Bridge.

Auto-Tuning

The mechanical positions of the various parts of an animatronics toy can vary from one unit to another. The servo chip 229 also uses analog parts to determine the position and drive, which can vary from unit to unit. As a result, it may be necessary to calibrate every animatronics toy and electronics combination to produce the correct visual results.

In one preferred embodiment, the system 200 has an auto-tuning procedure that is built into the animation player. A special animation track is played from a calibration chip which can be stored in a removable storage device. When the animation player recognizes the special code that indicates auto-tuning, it will pause the animation playback and go into auto-tune mode.

The basic principle of the auto-tuning procedure of one preferred embodiment is to drive the servo all the way to one end until mechanical motion ceases, determine the pulse length corresponding to that position, then drive the servo all the way to the other end and determine the pulse length for that position.

Once the minimum and maximum pulse lengths are determined, a small value is subtracted from these values, and the results are stored in the chip such as an EEPROM 234 as shown in FIG. 2. The value is subtracted so that in normal operation the servo will not drive into the end stops. In one embodiment, auto-tuning begins by sending out a very narrow pulse. This drives the servo to the "eyes closed" end. Since the pulse is too narrow the motor continues to drive, trying to reach the commanded position, the mechanical stops prevent it from reaching that position. The motor drive is fed back to the chip 202 though a pair of diodes, one on each end of the motor. The pin on the chip 202 will be low while the motor is driving. The auto-tune program notes that the motor is driving, and begins lengthening the pulse width. At some point the pulse will be long enough that the servo can drive to the commanded position, and the motor will stop driving. The microprocessor will note that the motor stopped driving, and record this as the "full eyes closed" pulse length. The microprocessor now sends out a very long pulse. This drives the servo to the full "mouth open" position, and tries to drive beyond that. Again, the mechanical stops prevent the servo from reaching the commanded position, so the motor continues to drive. As before, the system monitors the motor drive, this time while slowly reducing the pulse length. When the motor stops driving it indicates that the servo can reach the current position. This is recorded in the EEPROM as the "full mouth open" position. If auto-tuning fails because the motor never starts driving, or never stops driving, the servo will be commanded to the "eyes closed" position. If auto-tuning succeeds, the servo will be set to the center position. Auto-tuning is then complete, and the playback of the animation track is then resumed.

Auto-tuning Calibration Process

The calibration process begins with an announcement that auto-tuning will take place. The auto-tuning code is then present in the process, and auto-tuning proceeds as described above. When playback continues, the calibration process announces that it is moving the servo to the full mouth open position, does so, then announces that it will move to the full eyes closed position, and does so. The animatronics toy should be checked visually to see that the movements correspond to the description. If auto-tuning fails, pressing the fast forward button will start the auto-tune show again. The auto-tuning should be repeated once if it fails the first time. If it fails a second time, the toy should be rejected. The auto-tuning show may be followed by a section of a normal toy show. If so, this may be used to check that all parts are working correctly. The buttons may also be tested using this show.

Power On

When the system is first powered on, it performs some very basic initialization. It then attempts to read the calibration values out of the EEPROM. If the EEPROM can not be read or the values appear to be badly corrupted, the toy will use default calibration values instead. This will occur every time until the calibration process is run. Either the calibration values or the default values will be loaded into the pulse generator. These will then generate the correct pulse widths for any animation value between 0 and 255. These values are retained in memory until power is removed from the toy, or a reset occurs, typically as a result of a low battery voltage.

Sleep Mode

If the system is powered on but the toy is not activated to play an audio/animation program or show for several minutes, the system will enter into a sleep mode. In sleep mode, battery consumption is reduced to substantially a minimum, so battery length will not be adversely affected by leaving the toy with the power switch in the ON position for extended periods of time. Memory values are also retained in sleep mode. This includes the current position in a show, and the current show number. The servo calibration values are also retained. In some versions, just before entering sleep mode the toy will close its eyes if they are open. This way, the child is greeted by a toy bear who appears to be sleeping which can be awakened with the play button. Only the play button will wake from sleep mode. Neither the volume control nor fast forward button will wake the system from sleep.

EEPROM Calibration Chip

The EEPROM chip 234 is a typical 16 byte serial EEPROM using I2C protocol. A software routine is used to provide the clock and data for writing, or provide the clock while accessing the data for reading. Only 4 bytes are used in the chip, two bytes each for the minimum and maximum servo pulse widths.

H-Bridge

The H-Bridge 226 to drive the motor comprises lower H-Bridge transistors that are part of the servo chip, upper H-Bridge transistors which are discrete, and upper transistor drive transistors, which are also discrete. In one embodiment, the bases of the upper H-Bridge transistors are connected to the servo chip in a manner known in the art. The servo will operate in a known manner: the left upper transistor and the lower right transistor will conduct for one motor direction, and the upper right and lower left transistor will conduct for the other direction. Thus, approximately full battery voltage, minus 2*Vbe(sat) drop, will be applied to the motor to drive it in either direction. In one embodiment, the servo chip is analog in nature and draws considerable power when idle. If the servo chip was left powered when the toy is powered down, it would drain the battery in a short time. As this is unacceptable, the chip controls the servo chip power. Power is removed from the servo chip when the toy is powered down. If the upper H-Bridge transistors are left connected to the V+ line when the servo chip is powered down, the base voltage on both transistors will be pulled low, and both transistors will be driven into saturation. This will also draw a moderate amount of power from the battery. The traditional solution would be to put a transistor between the emitters of the upper H-Bridge transistors and the battery, and allow this transistor to go open when powering down the servo. However, this method introduces an unacceptable voltage drop in the servo, resulting in the motor running too slowly due to the reduced voltage. In one preferred embodiment, the H-Bridge transistors remain connected to the battery, and the base leads from these transistors are disconnected from the servo chip when the servo is powered down. This is one of the purposes of the two drive transistors for the upper H-Bridge transistors.

Figure 3A:
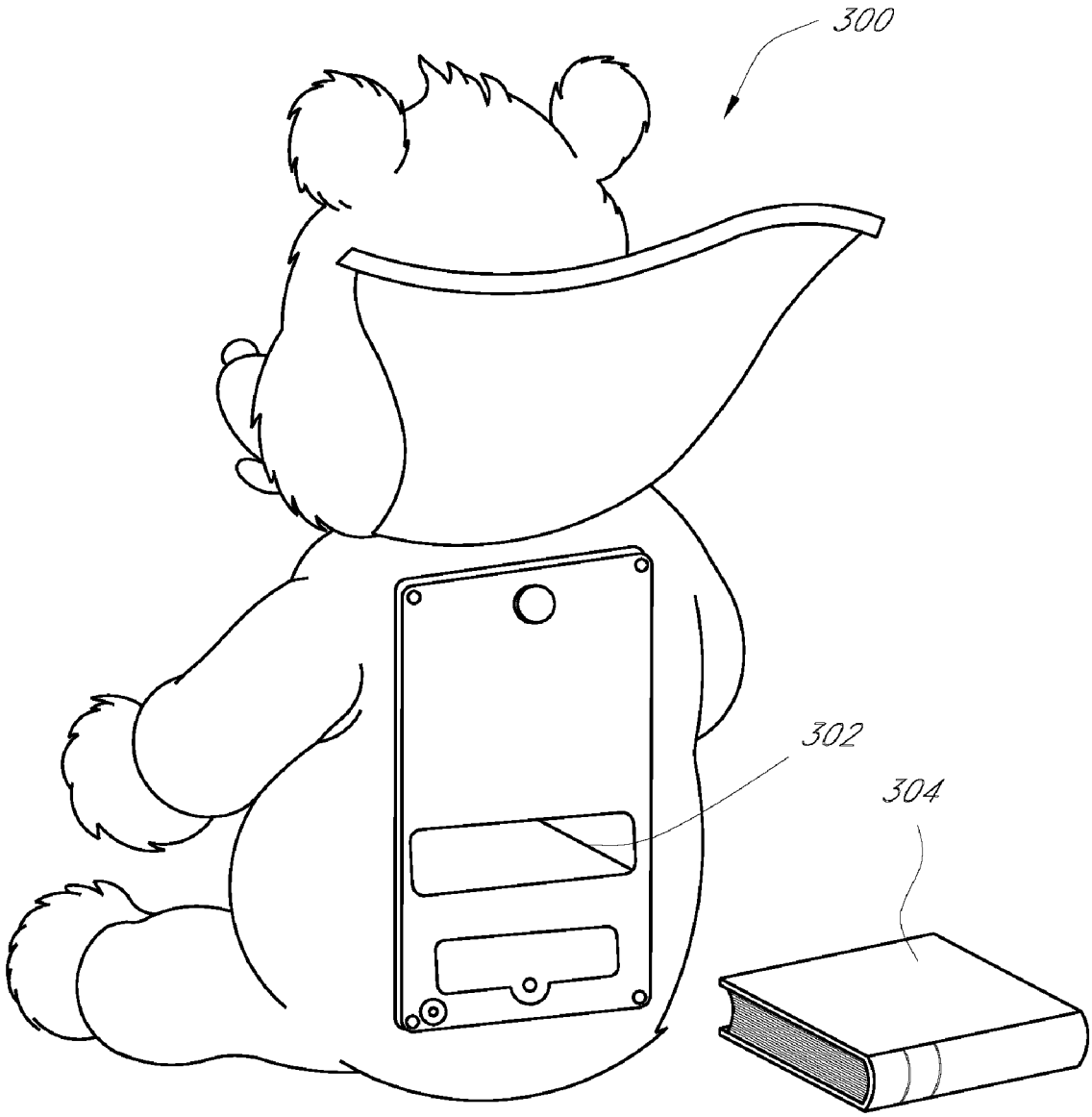
FIGS. 3A-3C schematically illustrate a talking toy incorporating the animatronics system of one embodiment of the present invention.
Figure 3B:
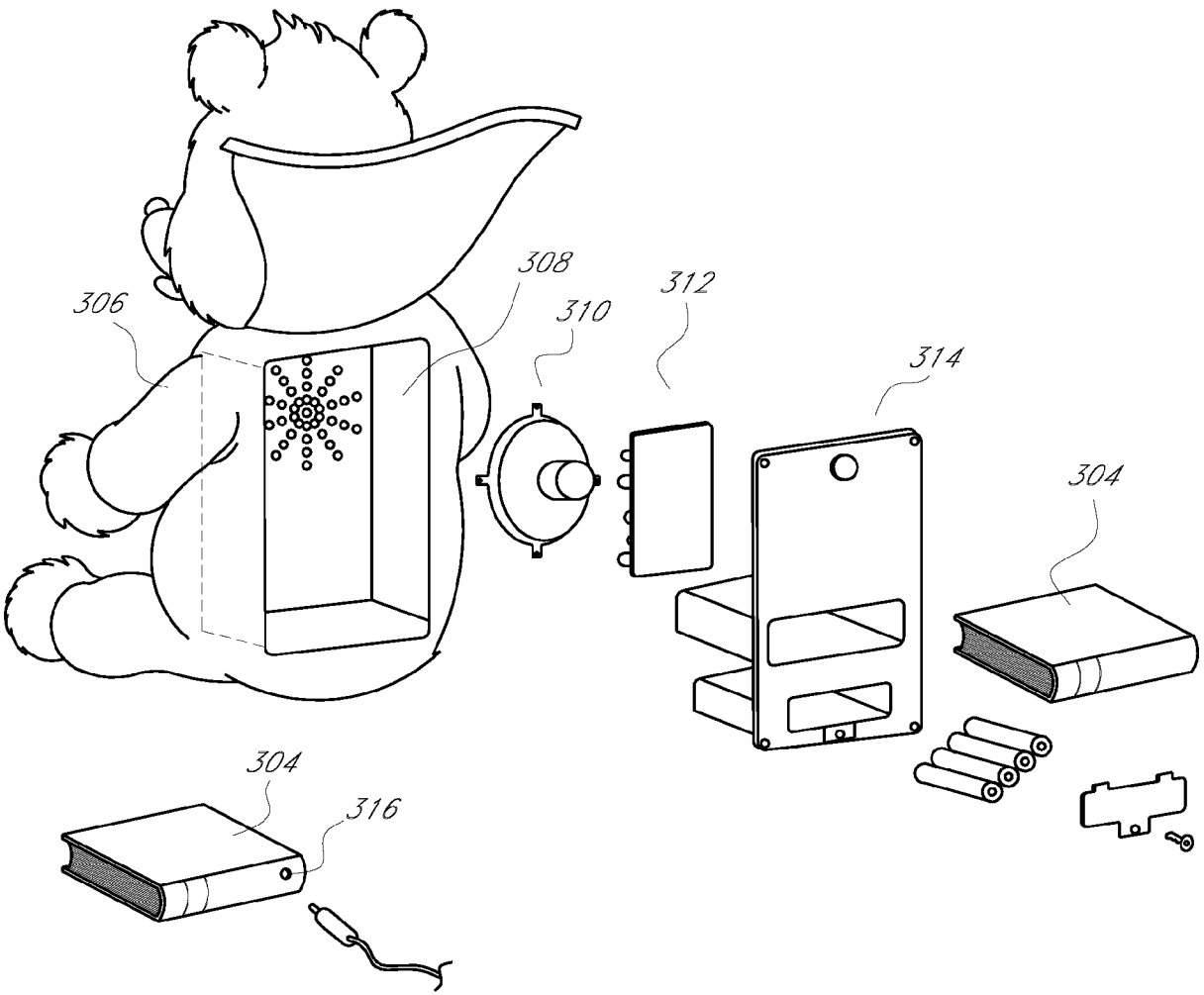
Figure 3C:
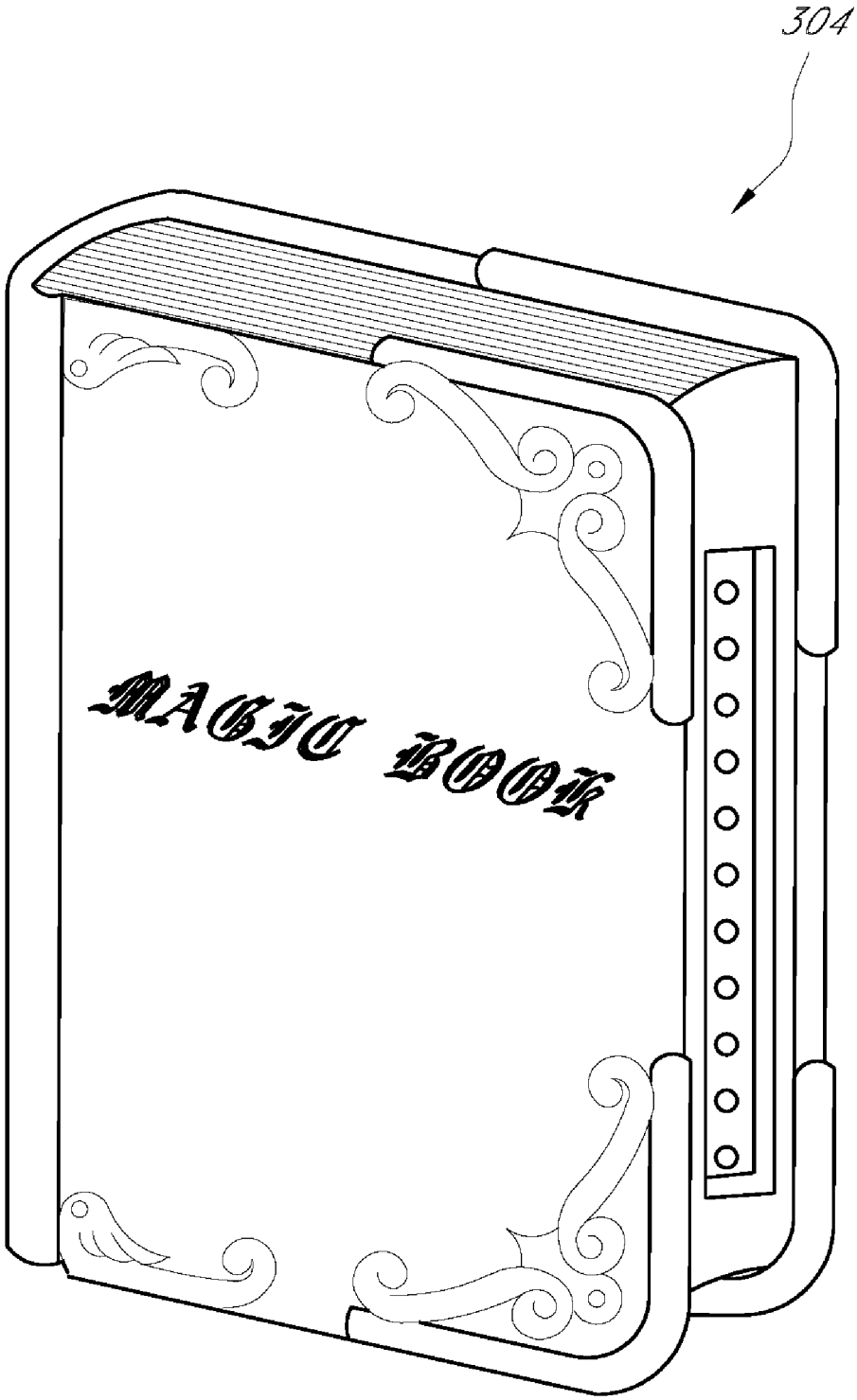

FIG. 3A illustrates the animatronics system of one preferred embodiment of the present invention in the configuration of a toy teddy bear 300. As shown in FIG. 3A, the toy 300 has an opening 302 in its chassis for receiving an audio and animation data storage device 304. The storage device 304 can comprise a flash memory chip positioned inside an outer shell made to resemble a book. FIG. 3B provides an exploded view of the toy 300 of FIG. 3A. The toy 300 comprises a general chassis 306 made to resemble a teddy bear and a cavity 308 therein configured to store the various electrical and mechanical components. The toy 300 comprises a speaker 310, a circuit board 312, a chassis cover 314 having the opening 302 for receiving the audio/animation data storage device, a plurality of batteries for powering the toy. Additionally, as shown in FIG. 3B, the audio/animation data storage device has a port 316 for receiving program data from external sources. FIG. 3C shows one embodiment of the data storage device 304, which is compact, lightweight and has an outer frame configured to resemble a story book. The device has a length of about 2.5 inches, a width of about 2 inches, and a thickness of about 0.625 inch. However, it will be appreciated that the data storage device is not limited to these dimensions or configuration.

Figure 4:
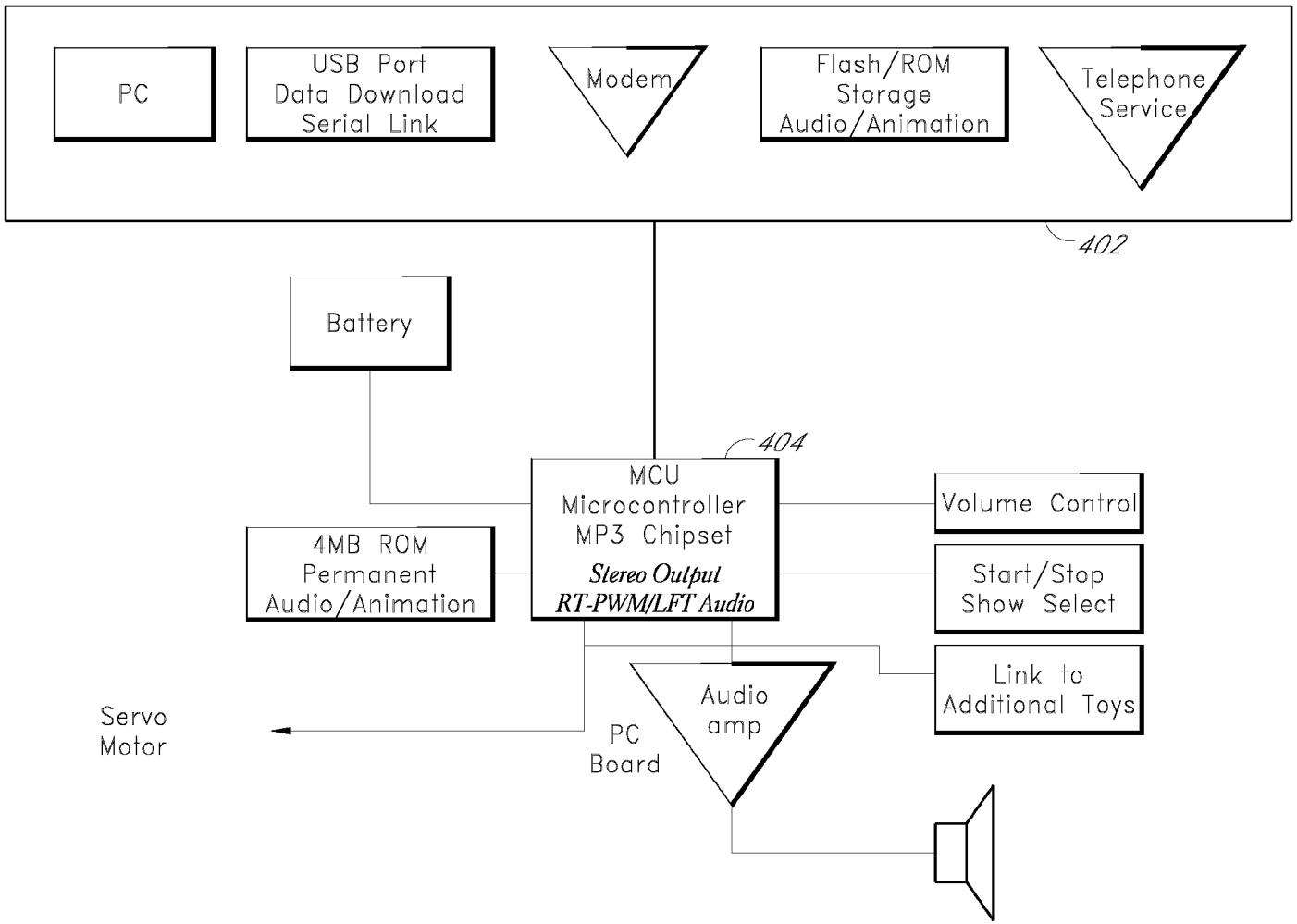
FIG. 4 is a general schematic illustration of the circuit components and external interface of one embodiment of the animatronics system incorporated in the talking toy of FIGS. 3A-3B.

FIG. 4 is a general schematic illustration of an audio and animation control system 400 that can be incorporated as part of the toy shown in FIGS. 3A-3C. The system 400 comprises a removable audio/animation data storage device 402 which can be replaced with additional peripherals including but not limited to flash media which are the removable devices that link the toy to other peripherals. The removable device 402 can come in several forms including, but not limited to, data storage containing audio and animation files, modem for uploading data from telephone system or internet DSL, USB serial link to connect to other USB devices for animation and audio control, link to other toys, games and videos for interactive play value, and serial ports. The system 400 also comprises a controller 404 which provides a mechanism for reading the data in the memory storage 402. Controller 404 can be adapted to decode audio data such as music data formatted in MP3 and animation control data. Controller 404 can decompress compressed data using any known and appropriate decompression technique. Additionally, they system 400 can be linked to additional toys so that the microcontroller 404 can control the sound and movement of more than one toy.

In another embodiment, a show, including audio and animation data, is preprogrammed with two analog audio tracks: audio (include voice, music) and with audible PWM (animation) in real time sync. The two tracks are compressed as a stereo digital MP3 file. The file is stored on a flash device and the MCU is used to control the external inputs (pushbuttons). During playback the MP3 file is converted back to two analog audio tracks, and sent to two locations: Show audio and servo control (PWM). The show audio is amplified and sent to a speaker the PWM is sent to the servo driver chip for motor control.

The animatronics system and method of certain preferred embodiments of the present invention utilize digital technology to form a lightweight and compact animatronics system having auto-tuning capabilities. The system further has a removable digital data storage device so that the show content can be replaced and interchanged easily.

Although the foregoing description of the preferred embodiments of the present invention has shown, described and pointed out the fundamental novel features of the invention, it will be understood that various omissions, substitutions, and changes in the form of the detail of the invention as illustrated as well as the uses thereof, may be made by those skilled in the art, without departing from the spirit of the invention. Particularly, it will be appreciated that the preferred embodiments of the invention may manifest itself in other shapes and configurations as appropriate for the end use of the article made thereby.

What is claimed is:

1. An animatronics system comprising:

a memory storage device containing digital audio and animation data;

a movable part;

an audio output device;

an electro-mechanical actuator adapted to move said movable part in response to the animation data; and a microcontroller electrically coupled to the memory storage device, wherein the microcontroller comprises an audio player and an animation player, said audio player is electrically coupled to the audio output device and adapted to process the audio data to result in production of sound through the audio output device, said animation player is electrically coupled to the electro-mechanical actuator and adapted to direct electrical signals to the electro-mechanical actuator in response to the animation data so as to cause movement of the movable part, wherein said movement is synchronized with the sound produced through the audio output device, wherein said audio player sends a current audio data position to the animation player at regular time intervals and if the animation player determines that the current audio data position is more than a predetermined number of frames off from a current animation data position, the animation player adjusts the current animation data position to correspond to the current audio data position.

2. The system of claim 1, wherein the audio player comprises firmware, hardware decoder, a digital to analog converter.

3. The system of claim 1, wherein the microcontroller has a built-in audio amplifier.

4. The system of claim 1, wherein the electro-mechanical actuator comprises a servo chip and a servo motor.

5. The system of claim 1, wherein the audio player is a MP3 player.

6. The system of claim 1, wherein the memory storage device comprises a flash memory chip.

7. The system of claim 1, wherein the memory storage device is removable.

8. The system of claim 1, further comprising an auto-tuning mechanism, wherein the auto-tuning mechanism automatically calibrates the system to compensate for variations in the arrangement of mechanical components of the system.

9. The animatronics system of claim 1, wherein the audio player sends a current audio data position to the animation player about once every 1 second.

10. The animatronics system of claim 1, wherein the predetermined number of frames is two frames or more.

11. A method of providing synchronized sound and movement in a toy, comprising:

programming audio and animation data in a digital data storage device;

providing a microcontroller having audio firmware adapted to read and process the audio data and animation firmware adapted to read and process the animation data, wherein said audio firmware sends a current audio data position to the animation firmware at regular time intervals and if the animation firmware determines that the current audio data position is more than a predetermined number of frames off from a current animation data position, the animation firmware adjusts the current animation data position to correspond to the current audio data position;

providing a user interface; and electrically coupling the microcontroller with the user interface and the digital data storage device.

12. The method of claim 11, wherein the audio data is programmed in an M-PEG1 audio layer format.

13. An animatronics toy, comprising:

a flash memory chip, said chip containing digital audio and animation files;

a microcontroller, said microcontroller having a first firmware adapted to play the audio files and a second firmware adapted to play the animation files, wherein said first firmware sends a current audio data position to the second firmware at regular time intervals and if the second firmware determines that the current audio data position, is more than a predetermined number of frames off from a current animation data position, the second firmware adjusts the current animation data position to correspond to the current audio data position;

an audio interface for generating sound based on the data in the audio files; and an animation interface for enabling movement of one or more mechanical components of the toy.

14. The toy of claim 13, wherein the animation interface comprises a servo chip, a motor, an H-Bridge unit, and a feedback pot.

* * * * *